US005120357A

United States Patent [19]

Eichberg et al.

[11] Patent Number: 5,120,357

[45] Date of Patent: Jun. 9, 1992

[54] LECITHIN CORROSION INHIBITOR

[75] Inventors: Joseph Eichberg, Atlanta; Kevin S. MacDonald, Tucker, both of Ga.

[73] Assignee: Amico, Inc., Atlanta, Ga.

[21] Appl. No.: 785,035

[22] Filed: Oct. 30, 1991

Related U.S. Application Data

[63] Continuation-in-part of Ser. No. 652,112, Feb. 6, 1991.

[51] Int. Cl.[5] ..... C04B 9/02

[52] U.S. Cl. ..... 106/14.22; 554/80

[58] Field of Search ..... 106/14.22, 14.23, 14.12; 260/403

[56] References Cited

U.S. PATENT DOCUMENTS

| | | | |
|---|---|---|---|
| 1,019,945 | 9/1909 | Buer | 260/403 |
| 1,673,615 | 6/1928 | Bollmann | 260/403 |
| 2,221,162 | 11/1940 | Ashburn | 260/403 |
| 2,403,284 | 7/1946 | Jacobs | 252/51 |
| 3,775,340 | 11/1973 | Rue | 106/14.23 |
| 4,174,296 | 11/1979 | Kass | 252/312 |
| 4,252,793 | 2/1981 | Altman | 424/199 |
| 4,305,853 | 12/1981 | Kronstein et al. | 206/403 |
| 4,520,153 | 5/1985 | Kronstein et al. | 106/14.12 |

OTHER PUBLICATIONS

Booklet-Alcolec-American Lecithin Company Inc. ©1947 pp. 1-20.

Gardner Color-Sampling And Analysis of Lecithin A.O.C.S. Official Method Ja Sep. 1987 3 pages.

*Primary Examiner*—William R. Dixon, Jr.
*Assistant Examiner*—Margaret V. Einsmann
*Attorney, Agent, or Firm*—Louis T. Isaf

[57] ABSTRACT

The present invention comprises a process for improving the corrosion inhibiting properties of lecithin by heating a lecithin oil composition for a period of time sufficient to produce darkening of the lecithin. An optional step further improves the corrosion inhibiting properties of the composition by combining zinc oxide with the lecithin oil prior to heating.

18 Claims, No Drawings

LECITHIN CORROSION INHIBITOR

CROSS-REFERENCE TO RELATED APPLICATION

This application is a continuation-in-part of application Ser. No. 07/652,112, filed Feb. 6, 1991.

FIELD OF THE INVENTION

This invention relates generally to corrosion inhibitors and in particular to lecithin and associated phosphatide compounds which can be used to inhibit the corrosion of metal surfaces.

BACKGROUND OF THE INVENTION

While the term "lecithin" classically refers to phosphatidylcholine, in commercial parlance "lecithin" is understood to include the mixture of phosphatidylcholine and other phosphatides such as phosphatidylethanolamine and phosphatidylinositol with minor constituents including sterol and carbohydrate. These and other examples can be found in the *Food Chemicals Codex*. The most abundant source of lecithin is an oil containing concentrate which is recovered in the degumming of vegetable oils and is comprised of lecithin and associated phosphatides. This concentrate usually comprises about 60 to 65% mixed phosphatides (lecithin along with naturally occurring minor constituents) and 35 to 40% oil from the degumming process.

It has been known that lecithin functions as an antioxidant in polyunsaturated fatty oils, in mineral oils and even in gasoline. It is also known that lecithin counteracts the corrosion of metals exposed to moisture and to solvent/moisture systems. However, the level of protection previously afforded by lecithin compositions has proven to be insufficient for commercial utilization.

SUMMARY OF THE INVENTION

Briefly described, the present invention provides a heat treated lecithin compound with significantly improved anti-corrosive characteristics. Changes in the character of lecithin (when used hereafter "lecithin" shall refer to the mixed phosphatides) occur when lecithin is heated to temperatures in excess of 70° centigrade for a period of time, the higher the temperature, the shorter the time. Substantial darkening of lecithin indicates that these changes have occurred.

Our work shows that the corrosion protection properties of lecithin increase dramatically after this substantial heat darkening. We find this for soybean lecithin and even more so for corn lecithin similarly treated. We find further that the corrosion protection properties can be enhanced by adding a minor amount of zinc oxide to lecithin before the heat treatment.

Lecithin from other sources can, of course, be used as commercially available, for example, peanut lecithin, safflower lecithin, or rapeseed lecithin. Vegetable seed oils generally contain appreciable amounts of lecithin.

It is therefore an object of the present invention to provide method and product by the preparation of a corrosion inhibiting lecithin composition which may include zinc oxide.

Also an object of this invention is to provide anti-corrosive agents which comprise significantly heat darkened lecithin compositions to which thinning or thickening agents have been added.

A further object of this invention is to provide an effective method of corrosion protection for surfaces of materials subject to corrosion.

Another object of the present invention is to provide corrosion protection to metal surfaces, whereby the protective coating could subsequently be easily removed with a suitable solvent.

Other objects, features and advantages of the present invention will become apparent upon reading and understanding this specification.

DETAILED DESCRIPTION

The method of the present invention comprises the step of heating lecithin, preferably substantially in excess of about 70° centigrade, and most preferably to temperatures between 130° and 160° centigrade, to produce substantial darkening in the color of the lecithin. Experimental results show that an embodiment of the present invented method utilizing heat darkened corn lecithin provides better protection from corrosion than a heat darkened soybean lecithin embodiment of the present invented method which has a similar phosphatide content.

In alternate embodiments of the present invention heat darkened lecithin is applied full strength to a metal surface, or may contain an added oil or other thickening or thinning agent. The added agent will vary from a thickening agent, such as a grease, or even a finely powdered solid to a fluidizing agent, such as mineral oil or fatty oil, depending on the conditions of use. An alternate method also includes the step of mixing a small amount of zinc oxide (generally 1 to 10% by weight) with the lecithin before heating.

The following examples are illustrative of the present invention, and while they cover specific embodiments of the present invention, it will be readily apparent to one skilled in the art that these are given by way of explanation, not as limitation, and that numerous changes in the details may be made without departing from the spirit and scope of the invention as hereinafter claimed.

EXAMPLE 1

Comparative exposure tests were conducted by placing 3 inch by 3 inch test panels of automotive steel (R-36 Q-Panels) in a humidity-condensation tester in an inclined position, for periods of 40 to 60 days. A control panel, coated only with unmodified mineral oil (URSA P-150, made by Texaco) developed increased corrosion areas over 50% of the exposed surface area after 14 days, over 70% of the exposed surface area after 21 days, and 80% of the exposed surface area after 42 days.

EXAMPLE 2

A second control test demonstrates the protective benefits of lecithin, without heat darkening. In this test lecithin was added to the same mineral oil to form a 5% to 20% (by weight) lecithin solution. This composition was applied to test panels which were then placed in the humidity-condensation tester. After 42 days corrosion occurred over 10% to 40% of the surface area of the test panels as illustrated below.

| Concentration of ALCOLEC S in Mineral Oil | % Surface Areas Corroded After 42 Days of Exposure |
|---|---|
| 5% | 40% |

-continued

| Concentration of ALCOLEC S in Mineral Oil | % Surface Areas Corroded After 42 Days of Exposure |
|---|---|
| 10% | 20% |
| 20% | 10% |

EXAMPLE 3

Lecithin (ALCOLEC S soybean lecithin, as sold by American Lecithin Company, Danbury, Conn.) was heated for two hours to produce darkening, at a temperature of 160° centigrade. This heat darkened lecithin was then mixed with a mineral oil (URSA P-150) to form a 20% lecithin solution. A test panel coated with this solution was placed in a humidity-condensation tester in an inclined position for 42 days, after which only 5% of the surface area of the panel was corroded.

EXAMPLE 4

A blend of a major amount of corn lecithin, and a minor amount of soybean lecithin, heat darkened at 160° centigrade, for one hour was mixed with the same mineral oil to form a 20% lecithin solution. A test panel coated with this solution was placed in a humidity-condensation tester for 42 days, after which less than 1% of the surface area of the panel was corroded.

EXAMPLE 5

Corn lecithin heat darkened at 130° centigrade for one hour was mixed with the same mineral oil to form a 20% LECITHIN solution. A test panel coated with this solution was placed in a humidity-condensation tester for 42 days, after which 2% of the surface area of the panel was corroded.

EXAMPLE 6

Soybean lecithin was mixed with 2.5 % zinc-oxide and heat darkened at 140° centigrade for one and one-half hours, and this composition added to the same mineral oil to form a 20% lecithin concentration and coated on a test panel. The panel was placed in a humidity-condensation tester for 42 days, after which no corrosion was detectable on the surface of the panel.

EXAMPLE 7

Soybean lecithin was mixed with 2.5% zinc-oxide and heat darkened at 140° centigrade for one and one-half hours, and 10% of this composition was mixed with the same mineral oil. A test panel coated with this composition was placed in a humidity-condensation tester for 42 days, after which 5% of the surface area of the panel was corroded.

EXAMPLE 8

Soybean lecithin was mixed containing 2.5% added zinc-oxide and heat darkened at 140° centigrade for one and one-half hours, with the same mineral oil at 5% concentration. A test panel coated with this composition was placed in a humidity-condensation tester for 42 days, after which 6% of the surface area of the panel was corroded.

EXAMPLE 9

To corn lecithin was added 2.5% zinc-oxide and the mixture heat darkened at 140° centigrade for one hour, then 20% was added to a protective oil. A test panel coated with this composition was placed in a humidity-condensation tester for 42 days, after which no corrosion was detectable on the surface of the panel.

EXAMPLE 10

To corn lecithin was added 2.5% zinc-oxide and the mixture heat darkened at 140° centigrade for one hour, then 10% was added to a protective oil. A test panel coated with this solution was placed in a humidity-condensation tester for 42 days, after which less than 1% of the surface area of the panel was corroded.

EXAMPLE 11

To corn lecithin was added 2.5% zinc-oxide and the mixture heat darkened at 140° centigrade for one hour, then 5% was added to a protective oil. A test panel coated with this solution was placed in a humidity-condensation tester for 42 days, after which 3% of the surface area of the panel was corroded.

EXAMPLE 12

To corn lecithin was added 2.5% zinc-oxide and the mixture heat darkened at 140° centigrade for one hour, then 2% was added to a protective oil. A test panel coated with this solution was placed in a humidity-condensation tester for 42 days, after which 5% of the surface area of the panel was corroded.

It will be apparent, upon practicing the foregoing Examples 3–12, that the lecithin has been substantially heat darkened to a point where it is no longer possible to make a Gardner color reading; that is, the lecithin has been darkened to a color which exceeds the maximum Gardner Standard of 18 Gardner. The Gardner color Standards and their use are considered well known in the industry. With respect to the most preferred embodiments of the present invention, the term substantial darkening refers to this darkening of the lecithin to a color which exceeds 18 Gardner.

Whereas the present invention has been described in detail with specific reference to particular embodiments thereof, it will be understood that variations and modifications may be effected within the spirit and scope of the present invention as hereinbefore described and as defined in the appended claims.

We claim:

1. Method of improving the corrosion inhibiting properties of lecithin, comprising the step of heating the lecithin to a temperature above 70° centigrade for a period of time sufficient to produce substantial darkening of the lecithin.

2. Method of creating an improved lecithin corrosion inhibiting composition, comprising the steps of combining zinc-oxide with lecithin and heating this composition to a temperature above 70° centigrade for a period of time sufficient to produce substantial darkening of the lecithin.

3. Method of claim 2, wherein the proportion of zinc-oxide to lecithin, by weight, is generally no greater than 1:9.

4. Method of claim 1, further comprising the step of adding, before or after the heating to produce substantial darkening of the lecithin, an agent selected from the group consisting of greases, powdered solids, mineral oils and fatty oils, wherein the lecithin bears a percentage of 5% or greater to the whole.

5. Method of claim 1, in which the lecithin is heated to a temperature in the range of about 130° centigrade to about 165° centigrade.

6. Method of claim 2, in which the lecithin is heated to a temperature in the range of about 130° centigrade to about 165° centigrade.

7. A corrosion inhibiting composition comprising substantially heat darkened lecithin and an agent selected from the group consisting of greases, powdered solids, mineral oils and fatty oils, wherein the lecithin bears a percentage of 20% or greater to the whole.

8. A corrosion inhibiting composition comprising substantially heat darkened lecithin and a fatty oil, wherein the lecithin bears a percentage of 20% or greater to the whole.

9. A corrosion inhibiting composition comprising substantially heat darkened lecithin and a mineral oil, wherein the lecithin bears a percentage of 20% or greater to the whole.

10. Method of protecting a metal surface against corrosion comprising the steps of:

heating lecithin to a temperature above 70° centigrade for a period of time sufficient to produce substantial darkening of the lecithin; and applying the substantially heat darkened lecithin to the metal surface.

11. Method of claim 10, further comprising the step of adding, before applying to the metal surface, a viscosity modifying agent, selected from the group consisting of greases, powdered solids, mineral oils and fatty oils, to the heat darkened lecithin solution, wherein the lecithin bears a percentage of 20% or greater to the whole.

12. Method of claim 5, wherein the heating step is further characterized by heating the lecithin for a time ranging from about 3 hours to about 1 hour.

13. Method of claim 6, wherein the heating step is further characterized by heating the lecithin for a time ranging from about 3 hours to about 1 hour.

14. Method of claim 10, wherein the applying step comprises the step of applying a coating containing the substantially heat darkened lecithin to the metal surface.

15. Method of claim 1, wherein the heating step is further characterized by heating the lecithin to produce darkening of the lecithin to a color exceeding 18 Gardner.

16. Method of claim 2, wherein the heating step is further characterized by heating the composition to produce darkening of the lecithin to a color exceeding 18 Gardner.

17. Method of claim 10, wherein the heating step is further characterized by heating the lecithin to produce darkening of the lecithin to a color exceeding 18 Gardner.

18. An improved lecithin corrosion inhibiting composition comprising a substantially heat darkened lecithin, said lecithin being characterized by a color which exceeds 18 Gardner.

* * * * *